US006003392A

United States Patent [19]

Lee

[11] Patent Number: 6,003,392

[45] Date of Patent: Dec. 21, 1999

[54] DRIVING MECHANISM FOR A WAVE-PRODUCING ORNAMENT

[76] Inventor: Vincent Kuo Wei Lee, No. 44, Lane 458, Sheh Chung Street, Taipei, Taiwan

[21] Appl. No.: 09/066,554

[22] Filed: Apr. 28, 1998

[51] Int. Cl.[6] ..... G09F 19/00; A63H 23/00

[52] U.S. Cl. ..... 74/44; 40/406; 446/267

[58] Field of Search ..... 74/40, 44, 45, 74/43; 40/406; 446/267

[56] References Cited

U.S. PATENT DOCUMENTS

| | | | |
|---|---|---|---|
| D. 356,281 | 3/1995 | Lee | D11/131 |
| 1,119,637 | 12/1914 | Roberts | 74/40 |
| 3,475,834 | 11/1969 | Bugg | 40/406 |
| 3,613,264 | 10/1971 | Vitka et al. | 40/406 |
| 4,596,160 | 6/1986 | Anderson et al. | 74/40 |
| 4,979,428 | 12/1990 | Nelson | 74/44 |
| 5,174,760 | 12/1992 | Gray | 40/406 |
| 5,572,903 | 11/1996 | Lee | 74/44 |
| 5,706,595 | 1/1998 | Lin | 40/406 |

*Primary Examiner*—Tamara L. Graysay
*Assistant Examiner*—William C Joyce
*Attorney, Agent, or Firm*—Bacon & Thomas

[57] ABSTRACT

A driving mechanism of a wave-producing ornament is mounted in a base of the ornament and includes a motor which rotates a disc. A connecting link is pivotally connected at a first end to an outer periphery of the disc and at a second end to a lower end of a push bar. The push bar is located in a channel integrally formed on the base of the ornament and has a round head projects from a top opening of the channel to contact with an end of a liquid container of the ornament above the base. When the disc rotates, it brings the connecting link to move in a circular motion and pull and push the push bar to descend and ascend along the channel reciprocatingly. Whereby, the liquid container is periodically lifted and lowered at one end by the round head of the push bar to produce waves in the container. A crank is pivotally connected at an inner end to the pivotal point on the disc with a decorated outer end projecting from a long slot on the base of the ornament, so that the rotating disc shifts the crank and causes the decorated outer end of the crank to reciprocate in the long slot.

1 Claim, 9 Drawing Sheets

DRIVING MECHANISM FOR A WAVE-PRODUCING ORNAMENT

BACKGROUND OF THE INVENTION

The present invention relates to a driving mechanism for a wave-producing ornament, and more particularly to a driving mechanism for a wave-producing ornament that includes a push bar periodically moving up and down to incline a liquid-container of the ornament, so that changeful waves can be produced in the container.

Generally, as shown in FIGS. 1 and 2, a wave-producing ornament includes a base 2 and an elongated, transparent liquid-containing container 1 pivotally supported by a supporting means 21 to locate above the base 2. The liquid contained in the container 1 is usually a dual-liquid consisting of oil and colored and specially treated water. When the container 1 seesaws, liquid in the container 1 flows to and fro to present changeful and dynamic waves. Such wave-producing ornament is widely welcomed by consumers and is a good interior decoration.

Conventional wave-producing ornaments usually include a motor which is disposed in the base 2 below the container 1 to rotate an eccentric wheel 22, so that the eccentric wheel 22 projects its outer periphery beyond an upper surface of the base 2 to push against a bottom surface of the container 1. With the eccentric rotation of the eccentric wheel 22, the container 1 is pushed to seesaw periodically. An invention of the inventor representing a first generation of the wave-producing ornament has adopted such eccentric wheel 22 as the driving mechanism for the wave-producing ornament. However, following drawbacks are found in the above conventional driving mechanism for a wave-producing ornament:

1. In consideration of an overall appearance and the magnitude of swing of the container 1, the eccentric wheel 22 is subject to some limitation in its size.
2. On the other hand, the weight of liquid in the container 1 forms a considerable load to the eccentric wheel 22, causing the eccentric wheel 22 that rotates while pushes the heavy container 1 to always frictionally contact with the bottom of the container 1. Therefore, the bottom of the container 1 is subject to wearing and noise is produced during the swing of the container 1.

It is therefore tried by the inventor to develop an improved driving mechanism for the wave-producing ornament to eliminate drawbacks found in the conventional driving mechanism.

SUMMARY OF THE INVENTION

A primary object of the present invention is to provide an improved driving mechanism for a wave-producing ornament, wherein a push bar having a round head contacted with a bottom end of the ornament is caused to periodically move up and down to incline the ornament, and, as a result, the frictional contact area between the push bar and the ornament and the noise produced during swinging of the ornament relative to the push bar can be minimized.

Another object of the present invention is to provide an improved driving mechanism for a wave-producing ornament, wherein a connecting link and a crank are pivotally connected at their one end to a common point on a rotational disc to increase the ornamental effect of the wave-producing ornament.

To achieve the above objects, the driving mechanism of the present invention includes a motor and a disc mounted in a base of a wave-producing ornament. The disc is driven by the motor to rotate about a central shaft. A connecting link is pivotally connected at a first end to a pivotal point near an outer periphery of the disc and at a second end to a lower end of a push bar. A crank is pivotally connected at an inner end to the first end of the connecting link. The push bar has a predetermined length and extends through a vertically extended channel integrally formed on the base at a predetermined position to project a round head and a proper length thereof beyond a top opening of the channel, such that the round head direct contacts with a bottom end of a liquid container of the wave-producing ornament. Whereby when the disc is rotated by the motor, the connecting link is brought by the disc to move in a circular motion and pulls and pushes the push bar to descend and ascend along the channel on the base in a stable and reciprocating manner and thereby periodically lowers and lifts one end of the container to produce dynamic and changeful waves in the container.

DETAILED DESCRIPTION OF THE PREFERRED EMBODIMENTS

Figure 1:
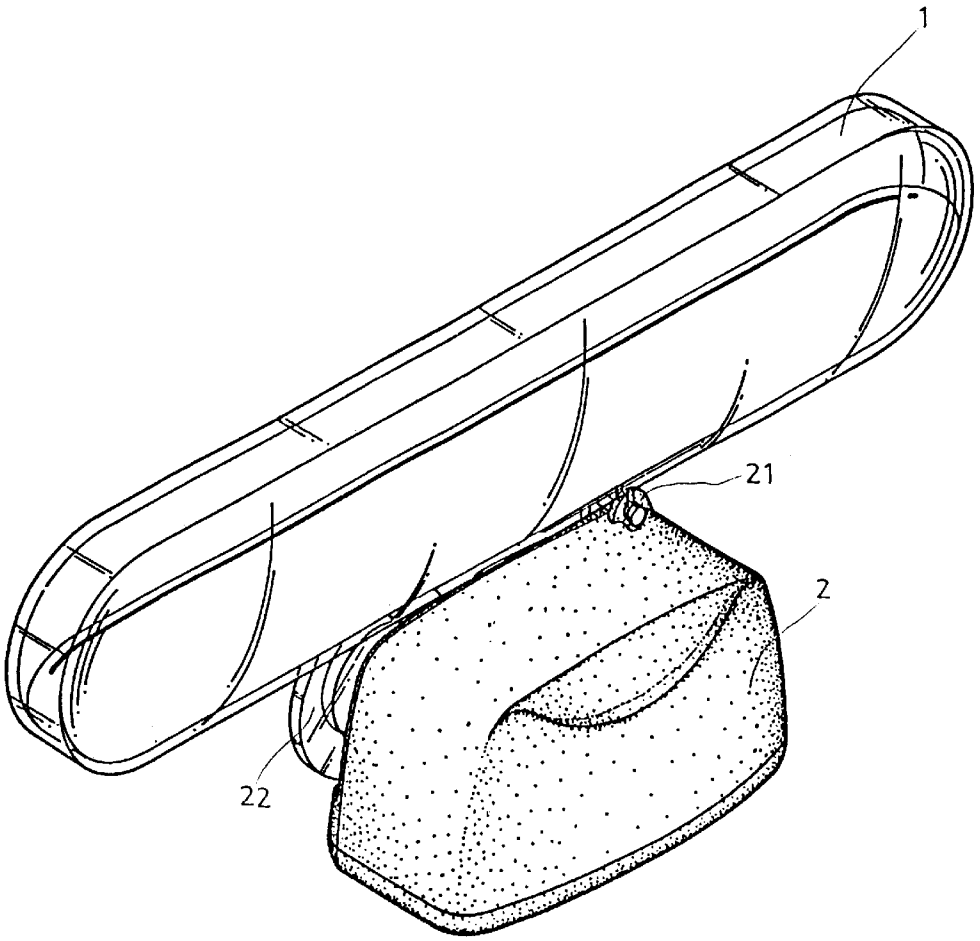
FIG 1 (prior art)
FIG. 1 is a perspective illustrating a wave-producing ornament using a conventional driving mechanism.
Figure 2:
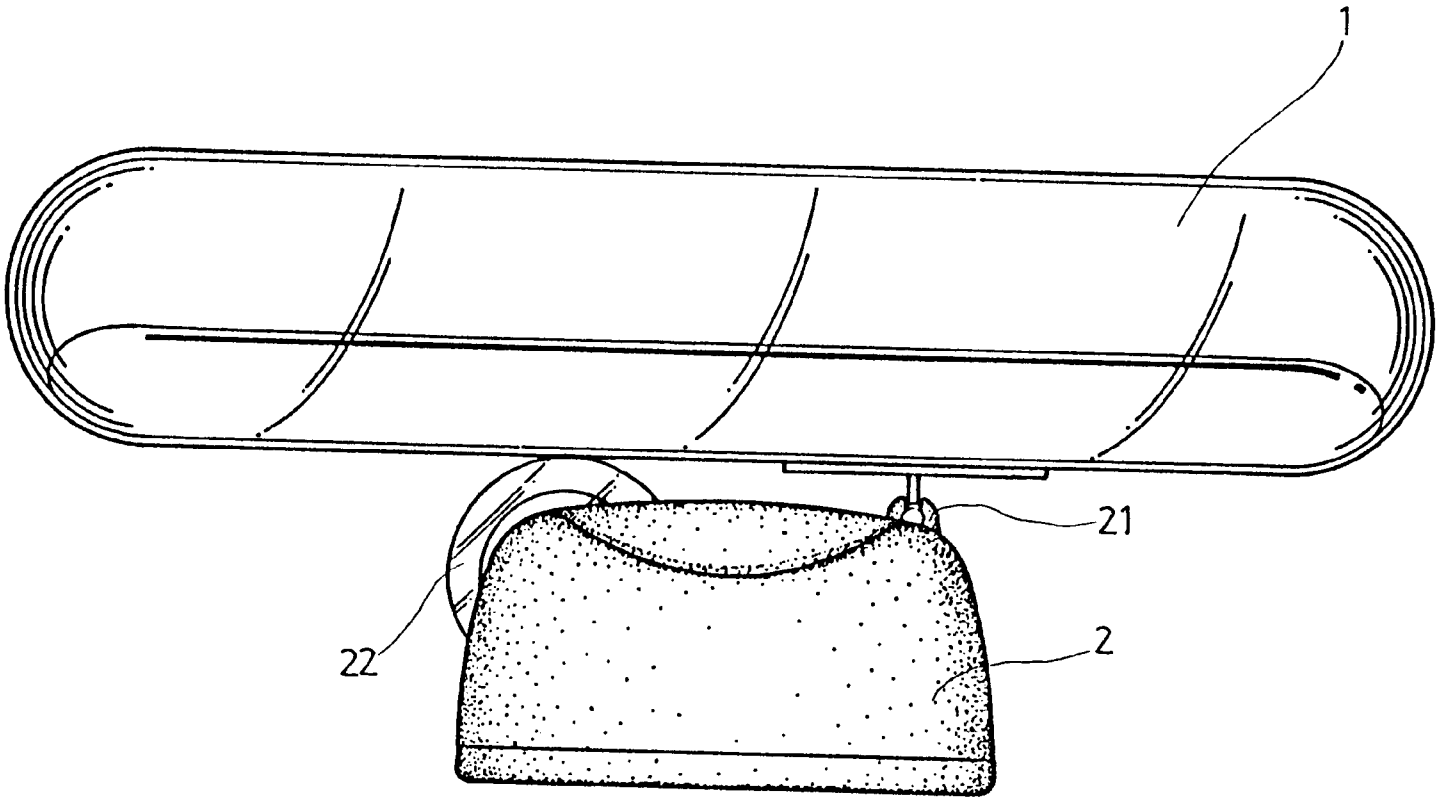
FIG 2 (prior art)
FIG. 2 is a side view of the wave-producing ornament of FIG. 1.
Figure 3:
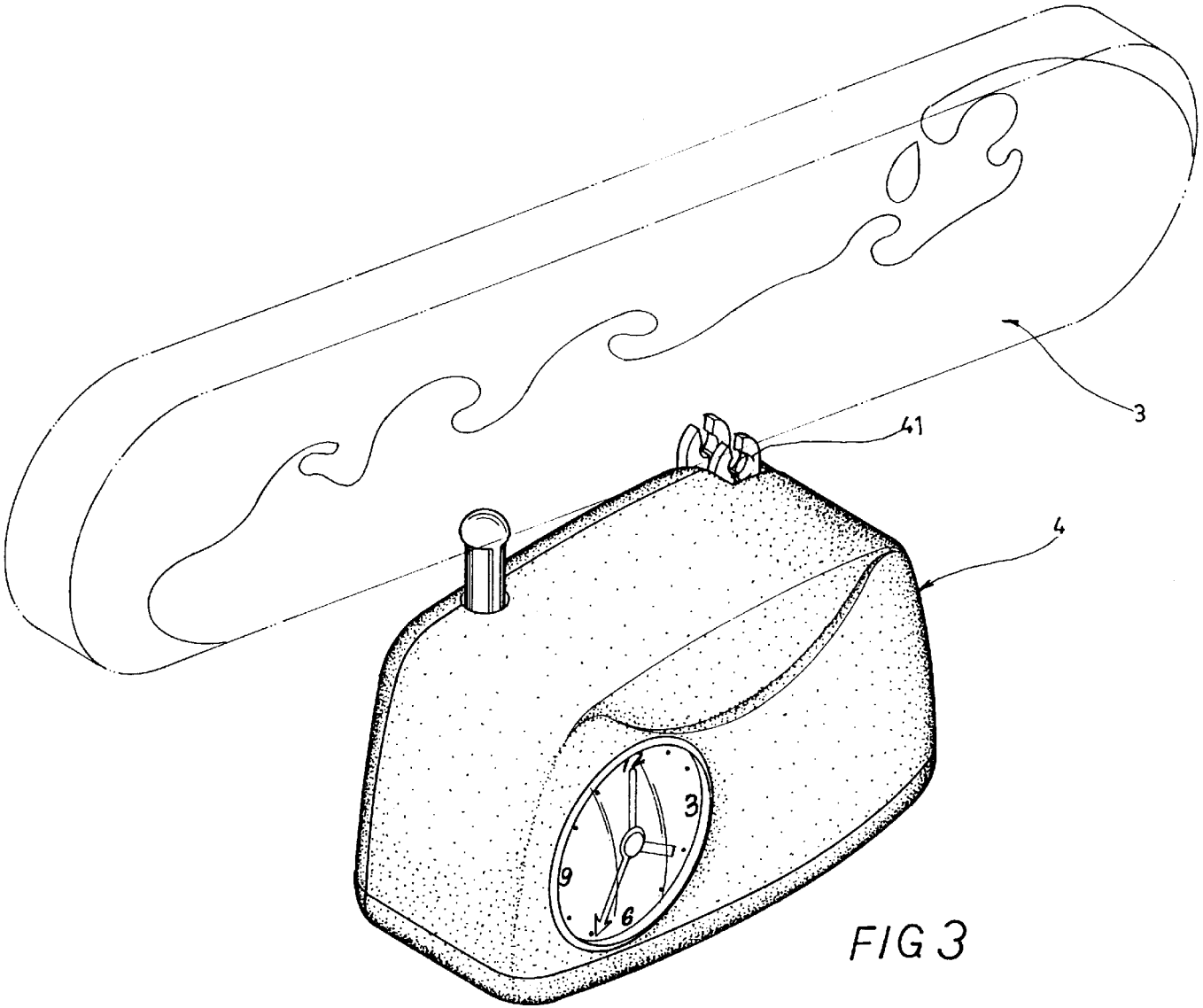
FIG. 3 is a perspective showing an example of a wave-producing ornament using the driving mechanism of the present invention.
Figure 4:
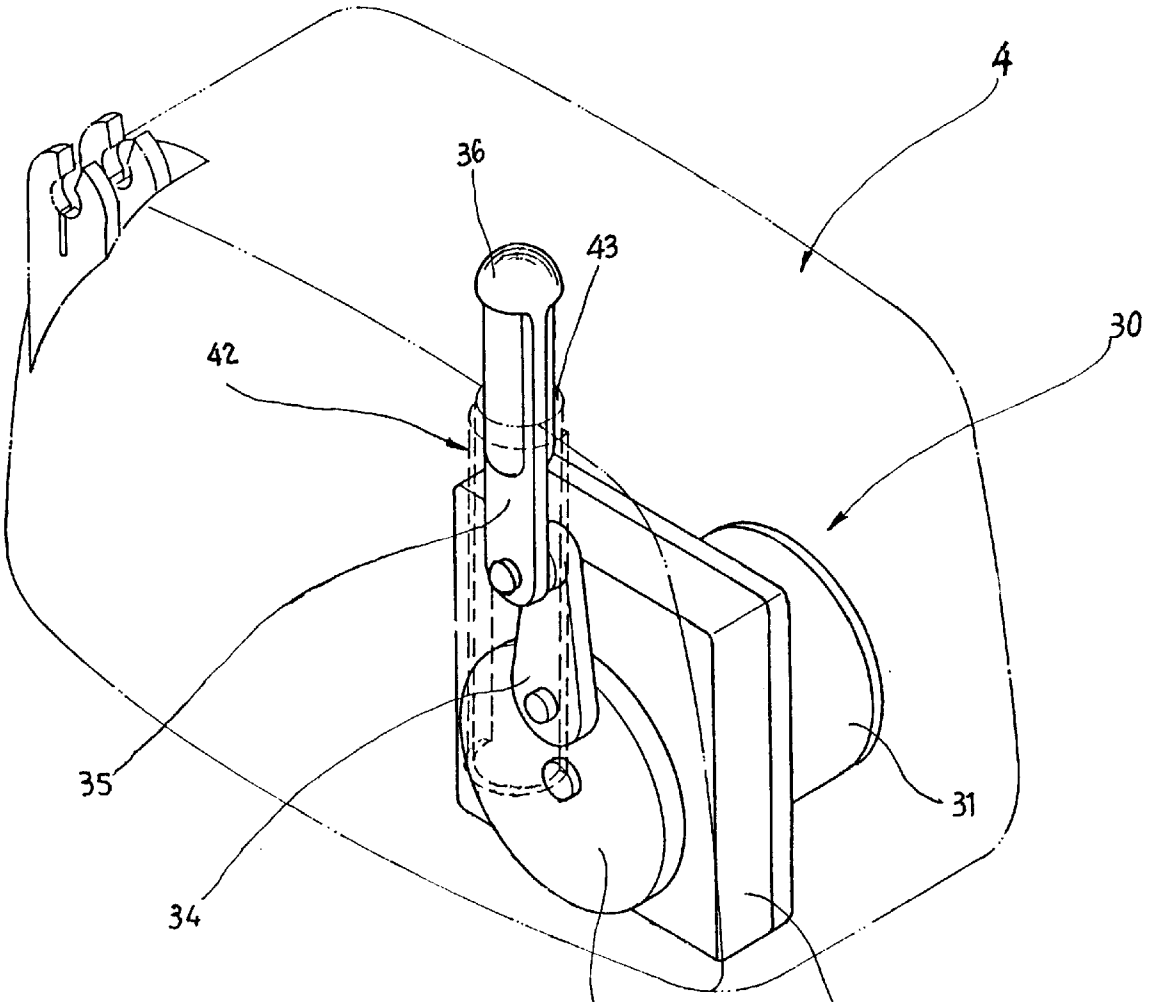
FIG. 4 is a schematic perspective showing the structure of the driving mechanism of the present invention for a wave-producing ornament.
Figure 5:
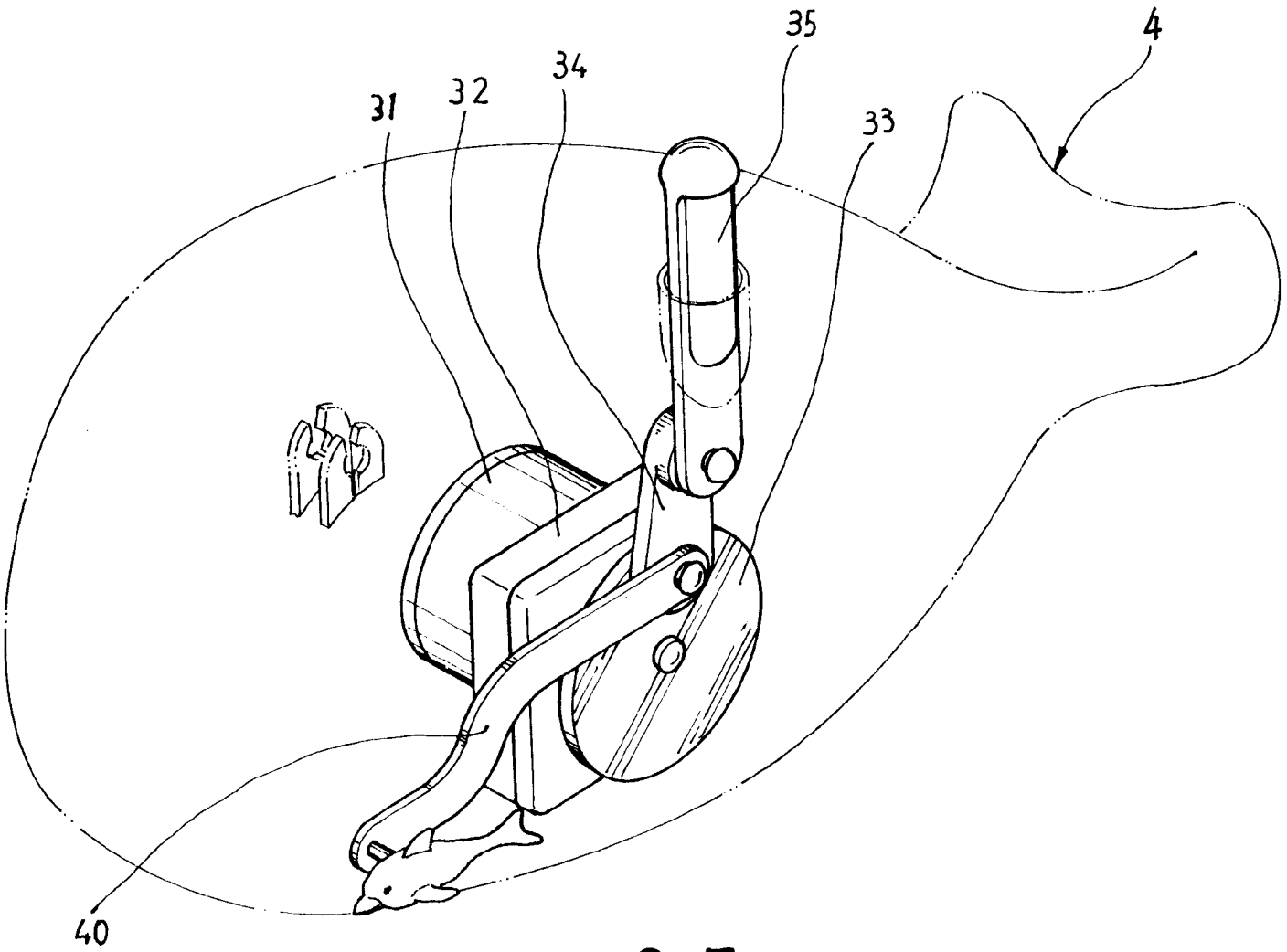
FIG. 5 is another schematic perspective of the driving mechanism of the present invention.
Figure 10:
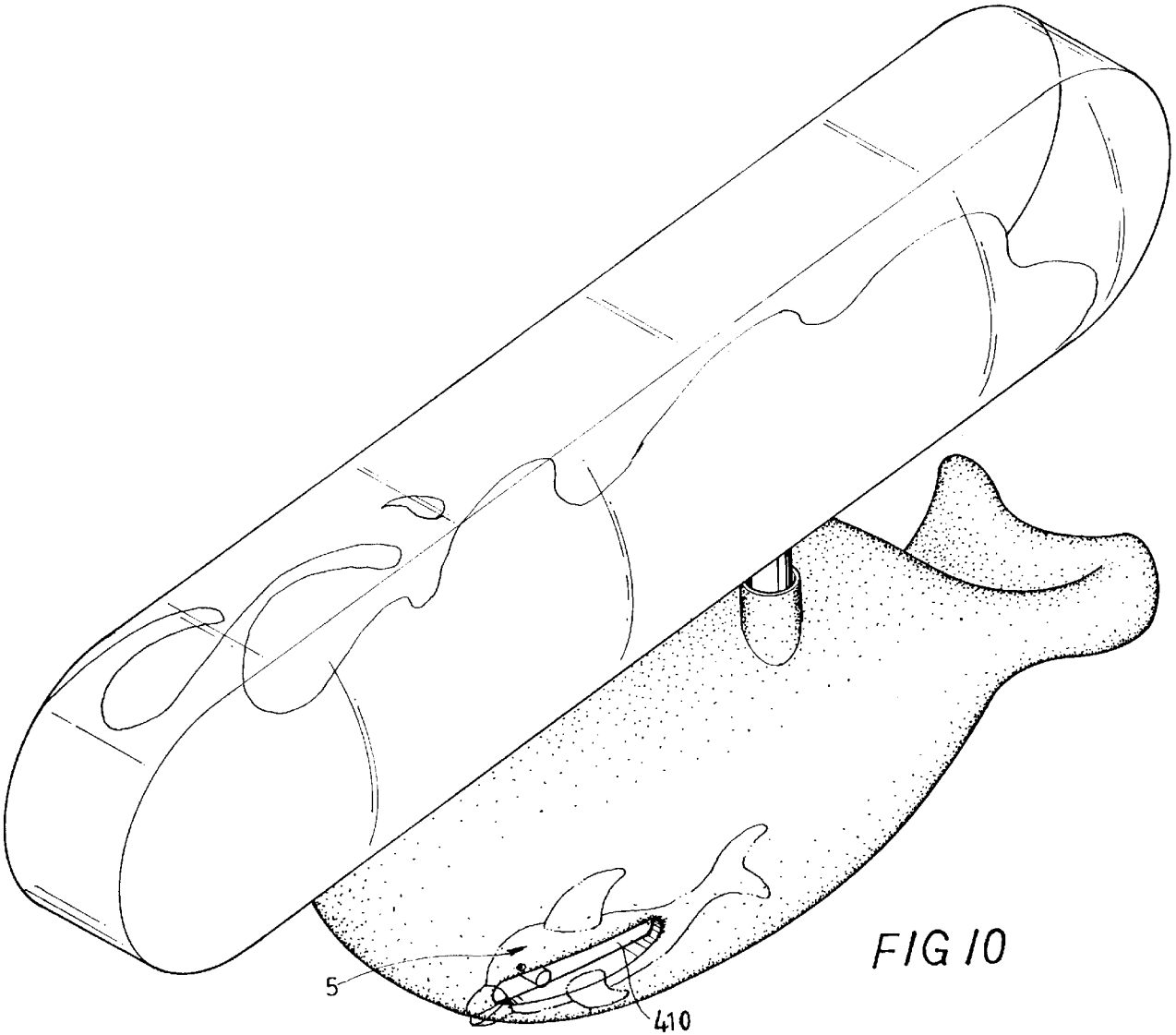
FIG. 10 is a perspective showing another example of wave-producing ornament using the driving mechanism of the present invention.
Figure 11:
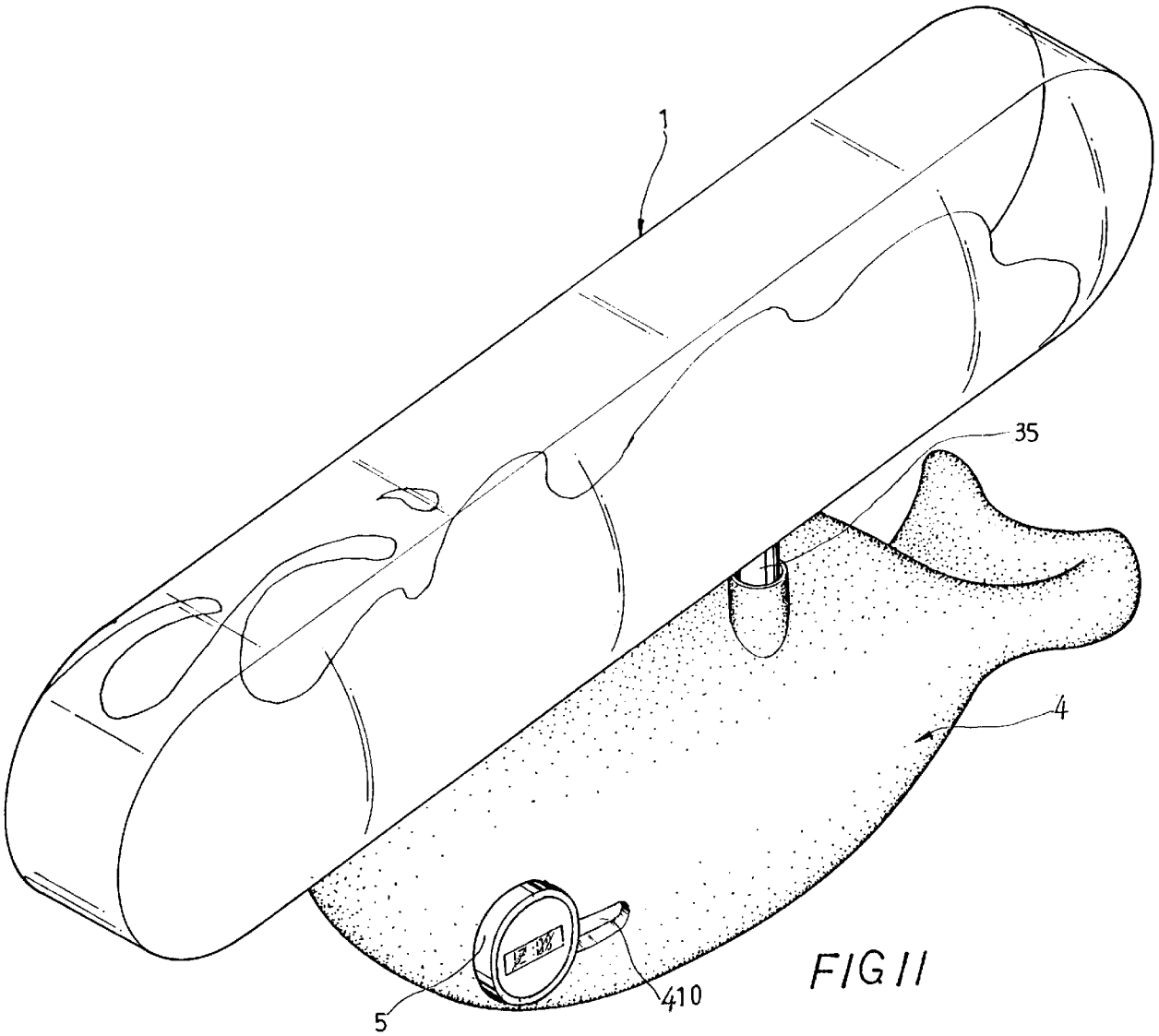
FIG. 11 is a perspective showing a further example of wave-producing ornament using the driving mechanism of the present invention.

Please refer to FIGS. 3 to 5. A wave-producing ornament using a driving mechanism of the present invention also includes a container 3 and a base 4. A supporting seat 41 projects from a suitable point on a top of the base 4 to pivotally support the container 3 above the base 4. A driving mechanism 30 is provided inside the base 4 at one side opposite to the supporting seat 41. The driving mechanism 30 includes a motor 31, a gearbox 32, and a disc 33. The disc 33 has a predetermined diameter and is brought by the motor 31 via the gearbox 32 to rotate about a central shaft. A connecting link 34 is pivotally connected at a first end to a pivotal point P1 near an outer periphery of the disc 33, and at a second end to a lower end of a push bar 35. A crank 40, also known as a driving link, having a predetermined length is pivotally connected at an inner end to the pivotal point P1, too, so that the crank 40 always moves along with the connecting link 34. An outer end of the crank 40 extends toward a bottom of the base 4 and has a sideward projected rod 401 provided thereto. A long slot 410 is formed on a front surface of the base 4 at a predetermined position, such that the sideward projected rod 401 of the crank 40 locates in the long slot 410 with an outer end projecting from the base 4 via the long slot 410. When the disc 33 rotates, the crank 40 is shifted with its outer end reciprocating in the long slot 410. Different ornament 5 can be connected to the outer end of the sideward projected rod 401 to locate in front of the base 4 and move along with the crank 40, as shown in FIGS. 10 and 11. The base 4 may be designed to have different shapes. FIGS. 3 and 10 illustrate two examples of differently shaped base 4.

The push bar 35 has a predetermined length and extends through a vertically extended channel 42 integrally formed on the base 4 at a predetermined position generally opposite to the supporting seat 41. A round head 36 and a proper length of upper part of the push bar 35 always projects beyond a top opening 43 of the channel 42, such that the round head 36 direct contacts with a point on a bottom surface of the container 3. Except a portion near the top opening 43, the channel 42 is not necessarily in the form of a closed sleeve.

Figures 6, 7:
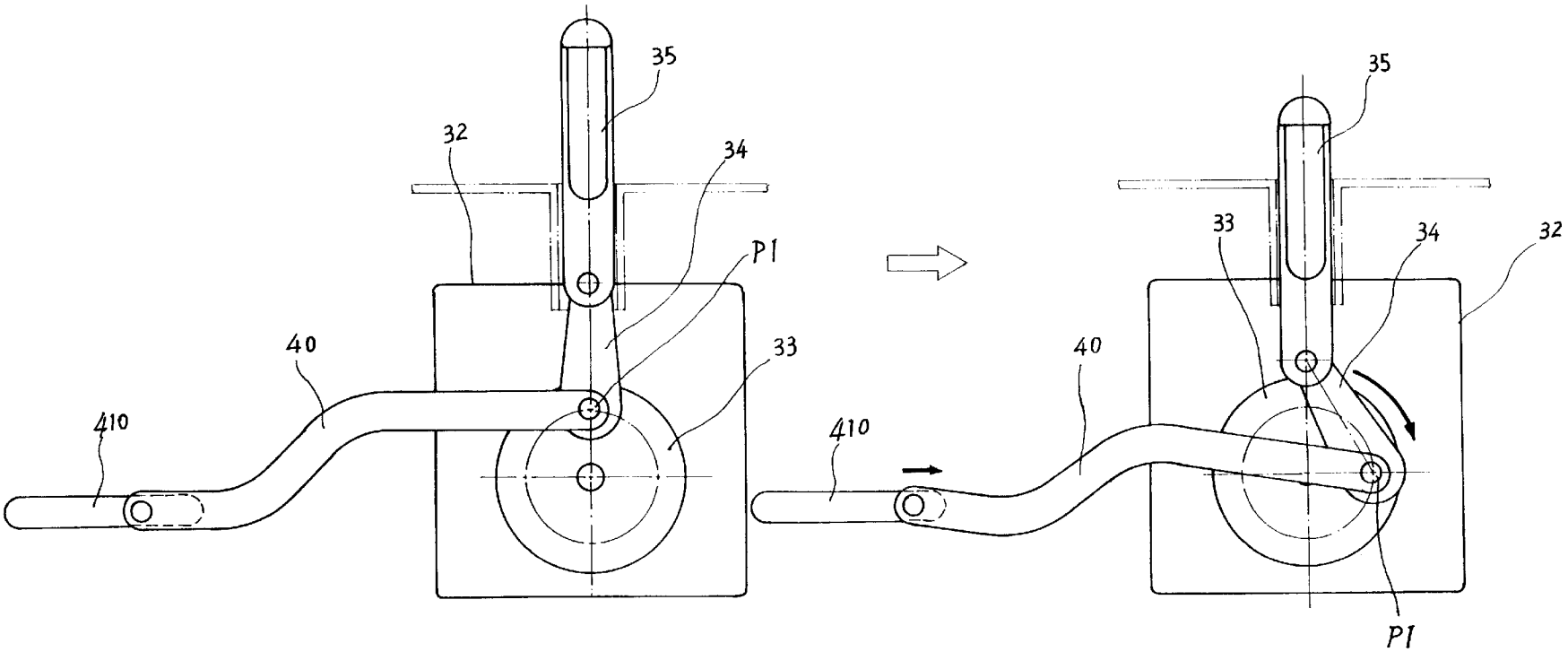
FIG. 6 illustrates the driving mechanism of the present invention in the first stage of operation thereof.
FIG. 7 illustrates the driving mechanism of the present invention in the second stage of operation thereof.
Figure 9:
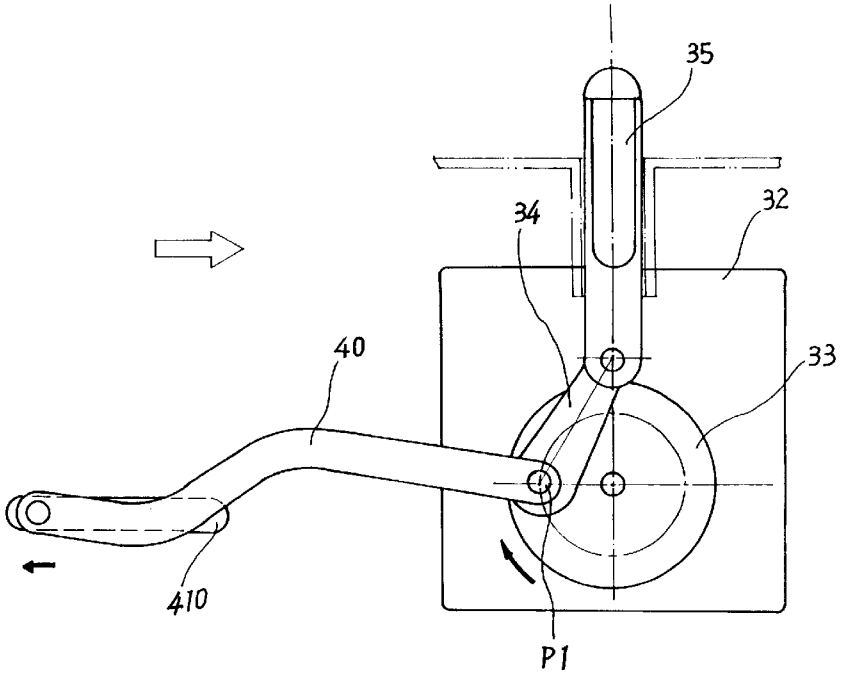
FIG. 9 illustrates the driving mechanism of the present invention in the fourth stage of operation thereof.
Figure 8:
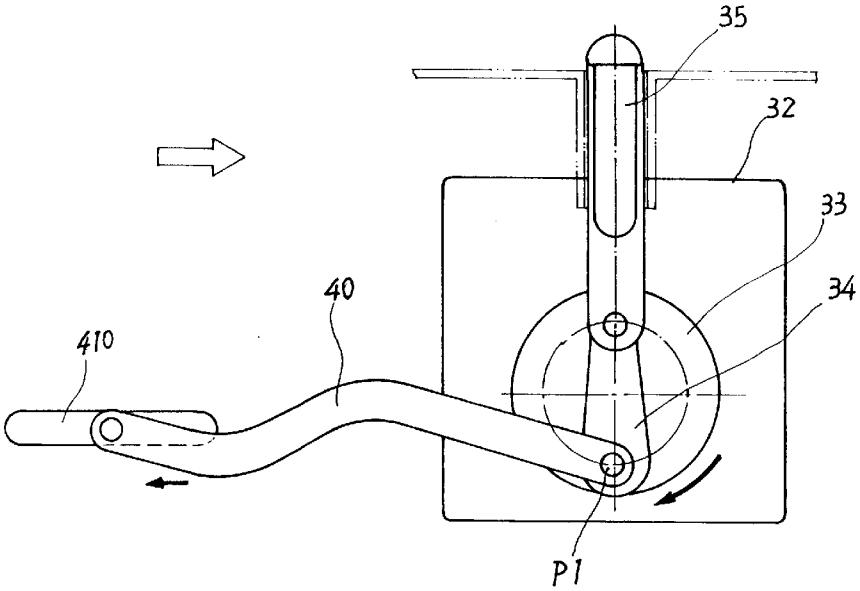
FIG. 8 illustrates the driving mechanism of the present invention in the third stage of operation thereof.

FIGS. 6 to 9 illustrate four different stages of operation of the driving mechanism 30. In FIG. 6, the disc 33 is rotated to position the pivotal point P1 at where the connecting link 34 is pivotally connected to the disc 33 to a highest point on the disc 33. At this point, the connecting link 34 is also located at a vertically highest position in its course of circular motion following the rotating disc 33. Meanwhile, the push bar 35 is pushed by the connecting link 34 to project from the channel 42 and locate at its highest position, and one end of the container 3 contacted with the push bar 35 is lifted by the projected round head 36 of the push bar 35 to a highest point, too. The disc 33 keeps rotating and brings the pivotal point P1 to positions between the highest position and a lowest position on the disc 33, as shown in FIG. 7. Since the push bar 35 is located in the channel 42 integrally formed on the base 4 and can only move up and down along a fixed vertical path defined by the channel 42, only the connecting link 34 pivotally connected at two ends to the disc 33 and the push bar 35 is biased when the disc 33 rotates. FIG. 8 illustrates the pivotal point P1 reaches a lowest position on the disc 33 and is vertically in alignment with the push bar 35 again. At this point, the push bar 35 is lowered in the channel 42 to a lowest position, and the end of the container 3 contacted with the push bar 35 also descends to a lowest point. The disc 33 keeps rotating and brings the pivotal point P1 to positions between the lowest and highest positions on the disc 33, as shown in FIG. 9, permitting the end of the container 3 contacted with the push bar 35 to ascend gradually until it reaches the highest point again. Following the rotation of the disc 33, the push bar 35 is pulled and pushed by the connecting link 34 to descend and ascend in the channel 42 in a stable and reciprocating manner, causing the container 3 to seesaw periodically and produces dynamic and changeful waves in the container 3.

What is claimed is:

1. A wave-producing ornament, comprising a motor and a disc mounted in a base of said wave-producing ornament, said disc being driven by said motor and a central shaft, a connecting link being pivotally connected at a first end to a pivotal point near an outer periphery of said disc and at a second end to a lower end of a push bar, a driving link being pivotally connected at an inner end to said pivotal point with an outer end sliding in a slot provided on said base for moving a movable ornament, said push bar having a predetermined length and extending through a vertically extended channel integrally formed on said base at a predetermined position to project a round head and a proper length thereof beyond a top opening of said channel, such that said round head directly contacts a bottom end of a liquid container of said wave-producing ornament, said liquid container being pivotally connected to the base; whereby when said disc is rotated by said motor, said connecting link is brought by said disc to move in a circular motion and pulls and pushes said push bar to descend and ascend in said channel on said base in a reciprocating manner and thereby causes said container to seesaw periodically and producing waves in said container.

* * * * *